US010260234B1

(12) United States Patent
Kuo

(10) Patent No.: US 10,260,234 B1
(45) Date of Patent: Apr. 16, 2019

(54) DEFORMED REINFORCING BAR, TRUSS STRUCTURE, AND FLOOR MODULE STRUCTURE

(71) Applicant: Yu-Liang Kuo, Zhubei (TW)

(72) Inventor: Yu-Liang Kuo, Zhubei (TW)

( * ) Notice: Subject to any disclaimer, the term of this patent is extended or adjusted under 35 U.S.C. 154(b) by 0 days.

(21) Appl. No.: 15/853,263

(22) Filed: Dec. 22, 2017

(51) Int. Cl.

| | |
|---|---|
| ***E04B 5/10*** | (2006.01) |
| ***E04B 5/16*** | (2006.01) |
| ***E04C 5/01*** | (2006.01) |
| ***E04C 3/08*** | (2006.01) |
| ***E04C 5/16*** | (2006.01) |
| ***E04B 5/29*** | (2006.01) |
| ***E04B 5/36*** | (2006.01) |
| ***E04C 3/04*** | (2006.01) |
| ***E04C 5/03*** | (2006.01) |
| *E04B 5/18* | (2006.01) |

(52) U.S. Cl.
CPC ..... *E04B 5/10* (2013.01); *E04B 5/29* (2013.01); *E04B 5/36* (2013.01); *E04C 1/38* (2013.01); *E04C 3/04* (2013.01); *E04C 3/08* (2013.01); *E04C 5/01* (2013.01); *E04C 5/03* (2013.01); *E04C 5/162* (2013.01); *E04B 5/18* (2013.01); *E04C 2003/0491* (2013.01)

(58) Field of Classification Search
CPC ..... E04B 5/10; E04B 5/29; E04B 5/40; E04B 5/38; E04B 5/36; E04C 3/08; E04C 2003/0491; E04C 3/294; E04C 3/04; E04C 5/01; E04C 5/00; E04C 5/03; E04C 5/20; E04G 11/38; E04G 11/44
See application file for complete search history.

(56) References Cited

U.S. PATENT DOCUMENTS

| | | | | | |
|---|---|---|---|---|---|
| 952,259 | A * | 3/1910 | Jenks | E04C 5/03 | 52/852 |
| 1,164,477 | A * | 12/1915 | Dale, et al. | E04C 5/03 | 52/851 |
| 1,280,046 | A * | 9/1918 | Kuhne | E04C 5/03 | 52/850 |
| 1,404,198 | A * | 1/1922 | Gerson | E04C 5/03 | 52/852 |
| 1,689,504 | A * | 10/1928 | Sheedy | E04C 5/03 | 52/852 |
| 2,123,239 | A * | 7/1938 | Griffel | E04C 5/03 | 138/175 |

(Continued)

*Primary Examiner* — Adriana Figueroa
*Assistant Examiner* — Jessie T Fonseca
(74) *Attorney, Agent, or Firm* — Muncy, Geissler, Olds & Lowe, P.C.

(57) ABSTRACT

The invention provides a deformed reinforcing bar, a truss structure and a floor module structure. The deformed reinforcing bar comprises an accommodating recess so that when used with a strut member to construct the truss structure of the invention as a top or bottom chord, the bending regions of the strut member can be fitted into the accommodating recess of the deformed reinforcing bar to simplify the welding process to achieve consistent welding quality as well as enhance the strength of the truss structure after pouring concrete. Additional transverse ribs and concave marks can be added to the surface of the deformed reinforcing bar and the surface of the accommodating recess to enhance bonding capability with concrete. The floor module structure can be assembled with a plurality of truss structure.

17 Claims, 15 Drawing Sheets

(56) References Cited

U.S. PATENT DOCUMENTS 2,418,382 A * 4/1947 Wennberg ..... E04C 5/03 52/857
2,418,383 A * 4/1947 Wennberg ..... E04C 5/03 52/857
2,630,890 A * 3/1953 Macomber ..... E04C 3/09 52/377
2,662,272 A * 12/1953 Macomber ..... B21D 47/04 29/417
3,186,206 A * 6/1965 Gillberg ..... B21B 1/163 72/194
3,292,337 A * 12/1966 Finsterwalder ..... E04C 5/03 52/853
3,335,539 A * 8/1967 Soretz ..... E04C 5/03 52/853
4,056,911 A * 11/1977 Tani ..... E04C 5/03 52/851
4,229,501 A * 10/1980 Kern ..... E04C 5/03 428/399
4,454,695 A * 6/1984 Person ..... E04B 5/40 52/334
4,715,155 A * 12/1987 Holtz ..... E04B 5/29 52/333
4,791,772 A * 12/1988 Potucek ..... E04C 5/03 403/314
4,811,541 A * 3/1989 Finsterwalder ..... E01D 19/16 52/853
4,856,952 A * 8/1989 Shaw ..... E04C 5/03 411/413
4,858,457 A * 8/1989 Potucek ..... B21B 1/163 72/187
4,922,681 A * 5/1990 Russwurm ..... B21B 1/163 52/853
4,953,379 A * 9/1990 Richartz ..... B21B 1/163 72/187
6,065,267 A * 5/2000 Fisher ..... E04C 3/08 52/655.1
2005/0108980 A1* 5/2005 Barmakian ..... E02B 3/28 52/831
2017/0030080 A1* 2/2017 Sacks ..... E04C 3/32

* cited by examiner

DEFORMED REINFORCING BAR, TRUSS STRUCTURE, AND FLOOR MODULE STRUCTURE

TECHNICAL FIELD

The technical field generally relates to a reinforcing bar used in concrete construction and buildings, and in particular, to a deformed reinforcing bar, truss structure, and floor module structure.

BACKGROUND

The conventional reinforcing bars used in reinforced concrete construction, such as the hot rolled reinforcing bar (40) shown in FIG. 14, are formed by hot rolling process to form transverse ribs (41) at regular intervals on the outer circumferential surface (21) of a reinforcing bar so as to enhance bonding capability with concrete. In addition, as a gap between the upper and lower rollers is required for the hot rolling process, two longitudinal ribs (42) will be formed along the rolling direction.

The conventional planar section module used in reinforced concrete constructing houses or buildings, such as, walls and floors, usually uses a mesh structure formed with a plurality of the conventional reinforcing bars and tied with metal wires at the intersections.

The aforementioned known enhanced steel structure used in construction share the same structure of using reinforcing bars to intersect one another, and then tie the intersecting reinforcing bars at the intersection to form a larger structure. The process is often performed manually, and thus the practice has the following shortcomings: the construction process is complicated, the manual process is difficult to implement so as to cause a large amount of labor costs, long construction duration and heavy labor intensity. The work is hard. Moreover, the quality of reinforcing bar labor is inconsistent, and the quality at worksite is difficult to control.

Another common approach in conventional construction work is to use the reinforcing bar to form a truss structure, by welding a plurality of support reinforcement bars between an upper chord and a lower chord.

The aforementioned truss structure is often constructed with the hot rolled reinforcing bar (40) as shown in FIG. 14, wherein the cross-section of the reinforcing bar are roughly circular, and the contacts between the upper/lower chord and the support reinforcement bars are often by merely touching as shown in FIG. 12B、FIG. 12B' and FIG. 12C、FIG. 12C' Even with welding, the following shortcomings are often observed in the conventional truss structure formed by the conventional reinforcing bar:

1. A higher welding technique is required.
2. Each contact point must be welded, which is costly and longer construction duration.
3. Consistent welding quality is difficult to achieved, which often results in the disengagement at the weld point (48) during pouring concrete and sabotage the strength of the finished structure.

In other words, the conventional truss structure formed by the conventional reinforcing bar is often accompanied by low efficiency, inconsistent quality, inability for higher throughput, and higher cost.

Other forms of truss structure, such as, the triangular truss structure shown in FIG. 13, comprises: two truss webs (93), one upper chord (95), two lower chord (94), two vertical reinforcing bars (96) and two horizontal reinforcing bars (97). The above structure of truss also suffers the following shortcomings:

1. Complicated structure.
2. Higher current power and higher energy-consumption is required.
3. The bonding weld at contact points often breaks off during pouring concrete.
4. The diameter of the chords must not be too large (often within 9-12 mm) and the diameter difference between the chords and truss webs must not be large, otherwise, the welding difficulty will increase and leads to poor yield rate and efficiency.
5. The structure is often only used in the floor structure module.
6. The use of resistance welding approach to form the truss structure often results in uneven welding strength, leading to buckling strength and bearing capacity of the quality of each weld is limited, unable to achieve the mechanical design of the truss bearing capacity. Also, the quality consistency is hard to maintain; and therefore, it is often necessary to use more steel trusses in actual application, resulting in waste.

SUMMARY

The object of the present invention is to provide a novel deformed reinforcing bar, for using in truss structure as top chord and bottom chord to be used in a reinforced concrete structure module for construction with convenience and ease.

Another object of the present invention is to provide a truss structure to be used in a reinforced concrete structure module for construction with convenience and ease.

Yet another object of the present invention is to provide a floor module structure for construction, using the above truss structure with the deformed reinforcing bar to achieve convenience and ease.

To achieve the above object, the present invention provides a deformed reinforcing bar, formed by a hot rolled process and applicable as a top chord or bottom chord to a truss structure, the truss structure further comprising a strut member fixed to the top chord and the bottom chord, the deformed reinforcing bar comprising: a long steel bar, roughly round shape in cross-section, disposed with an accommodating recess on circumference of the steel bar along length direction, the accommodating recess having a structure, width and depth matching with an outer diameter of the strut member and matching with a welding process used for constructing the truss structure; the deformed reinforcing bar having a plurality of transverse ribs on surface of the steel bar along length direction and separated with intervals, and surface of the accommodating recess having a plurality of concave marks along length direction and separated with intervals; a protruding rounded chamfer being disposed at between each of two edges of the accommodating recess and the surface of the long steel bar; wherein the strut member having bending regions along length direction fitted into the accommodating recess of the deformed reinforcing bar and welded to construct the truss structure.

In a preferred embodiment of the present invention, the accommodating recess of the deformed reinforcing bar comprises a continuous groove.

In a preferred embodiment of the present invention, the accommodating recess of the deformed reinforcing bar comprises a plurality of troughs arranged in a line and separated with intervals, each of the trough having a length longer than a maximum length of contact part of the bending regions of the strut member.

In a preferred embodiment of the present invention, the surface of the steel bar is further disposed with a plurality of concave marks along length direction and separated with intervals.

In a preferred embodiment of the present invention, the surface of the accommodating recess is further disposed with a plurality of transverse ribs along length direction and separated with intervals.

In a preferred embodiment of the present invention, bottom of the accommodating recess of the deformed reinforcing bar is further disposed with at least one continuous convex strip or a plurality of discontinuous convex strips along the length direction, and the convex strips extend in a direction parallel to or form a tilt angle with the length of the deformed reinforcing bar.

In a preferred embodiment of the present invention, the deformed reinforcing bar has a cross-sectional area roughly stays unchanged at any location along the length direction.

In a preferred embodiment of the present invention, a plurality of second troughs arranged in a line and separated with intervals is disposed on the circumference of the long steel bar and at opposite side of the plurality of troughs of the accommodating recess; the second trough has the same structure as the troughs of the accommodating recess; the troughs of the accommodating recess and the plurality of second troughs are not aligned along the length.

The present invention also provides a truss structure, which comprises: a strut member, being a reinforcing bar bended at intervals into a zigzag wave shape with a plurality of bending regions, the bending regions having outer vertexes forming two parallel lines; a top chord and a bottom chord, for fixed to the outer vertexes of the bending regions of the strut member; wherein the top chord and the bottom chord being a deformed reinforcing bar respectively, formed by a hot rolled process, and the deformed reinforcing bar comprising: a long steel bar, roughly round shape in cross-section, disposed with an accommodating recess on circumference of the steel bar along length direction, the accommodating recess having a structure, width and depth matching with an outer diameter of the strut member and matching with a welding process used for constructing the truss structure; the deformed reinforcing bar having a plurality of transverse ribs on surface of the steel bar along length direction and separated with intervals, and surface of the accommodating recess having a plurality of concave marks along length direction and separated with intervals; a protruding rounded chamfer being disposed at between each of two edges of the accommodating recess and the surface of the long steel bar; wherein the strut member having bending regions along length direction fitted into the accommodating recess of the deformed reinforcing bar and welded to construct the truss structure.

In a preferred embodiment of the present invention, the accommodating recess of the deformed reinforcing bar comprises a continuous groove.

In a preferred embodiment of the present invention, the accommodating recess of the deformed reinforcing bar comprises a plurality of troughs arranged in a line and separated with intervals, each of the troughs having a length longer than a maximum length of contact part of the bending regions of the strut member.

In a preferred embodiment of the present invention, the surface of the steel bar is further disposed with a plurality of concave marks along length direction and separated with intervals.

In a preferred embodiment of the present invention, the surface of the accommodating recess is further disposed with a plurality of transverse ribs along length direction and separated with intervals.

In a preferred embodiment of the present invention, bottom of the accommodating recess of the deformed reinforcing bar is further disposed with at least one continuous convex strip or a plurality of discontinuous convex strips along the length direction, and the convex strips extend in a direction parallel to or form a tilt angle with the length of the deformed reinforcing bar.

In a preferred embodiment of the present invention, the deformed reinforcing bar has a cross-sectional area roughly stays unchanged at any location along the length direction.

In a preferred embodiment of the present invention, a plurality of second troughs arranged in a line and separated with intervals is disposed on the circumference of the long steel bar and at opposite side of the plurality of troughs of the accommodating recess; the second trough has the same structure as the troughs of the accommodating recess; the troughs of the accommodating recess and the plurality of second troughs are not aligned along the length.

The present invention also provides a floor module structure, applicable to a pre-assembled construction process, comprising: a plurality of horizontal fixed steel bars, a plurality of wrapping wires, a bottom template, and a plurality of truss structures perpendicularly disposed on the bottom template, arranged in parallel and separated with intervals along a vertical direction; wherein each of the truss structures being as described earlier; a plurality of interval blocks being disposed between each truss structure and the bottom template along the vertical direction; a long reinforcement element being disposed beneath the bottom template at location corresponding to the truss structure; the wrapping wires penetrating the bottom template to fasten the top chord of the truss structure and the corresponding long reinforcement element; the horizontal fixed steel bars being disposed to set through under the top chord of the truss structure at two ends and the middle of the floor module structure, and welded or tied to fasten the horizontal fixed steel bars to the top chord to form the floor module structure.

The foregoing will become better understood from a careful reading of a detailed description provided herein below with appropriate reference to the accompanying drawings.

BRIEF DESCRIPTION OF THE DRAWINGS

The embodiments can be understood in more detail by reading the subsequent detailed description in conjunction with the examples and references made to the accompanying drawings, wherein.

DETAILED DESCRIPTION OF THE DISCLOSED EMBODIMENTS

Figure 1A:
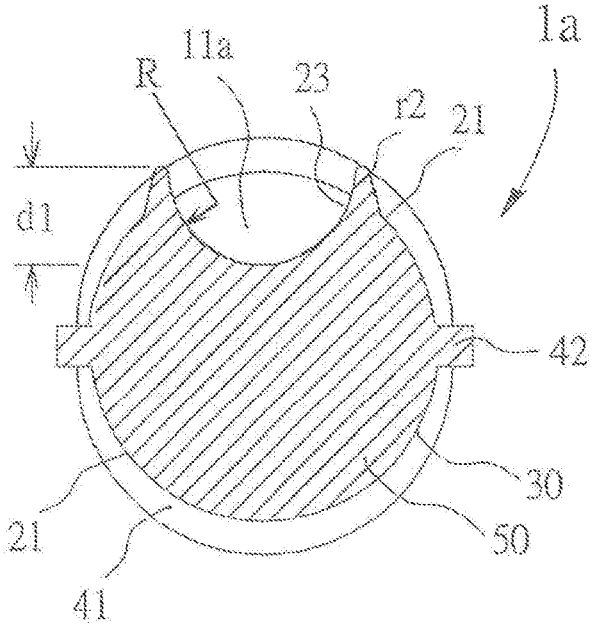
FIG. 1A shows a cross-sectional view along 1A-1A direction of the deformed reinforcing bar in accordance with the second embodiment of the present invention.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 6A:
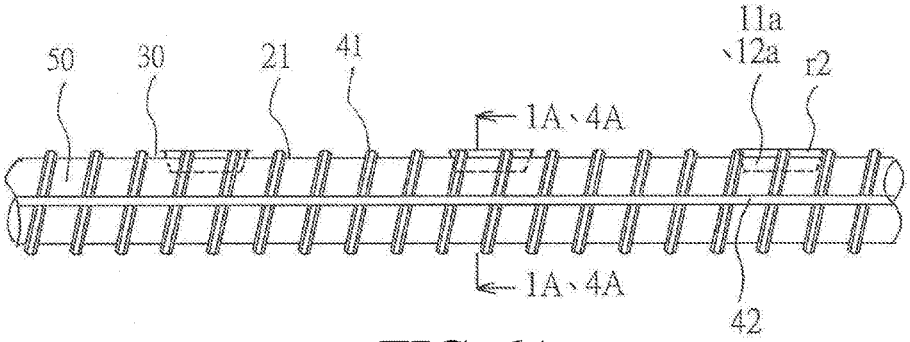
FIG. 6A shows a schematic view of a plurality of troughs arranged in a line along the length direction on circumference of the deformed reinforcing bar in accordance with an embodiment of the present invention.
Figure 6B:
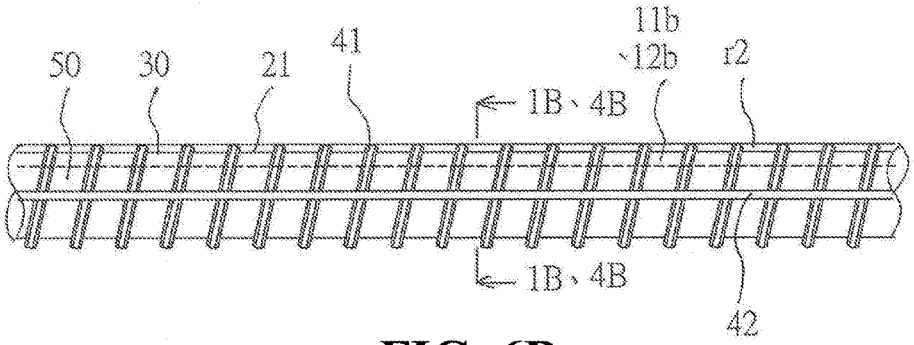
FIG. 6B shows a schematic view of a groove along the length direction on circumference of the deformed reinforcing bar in accordance with an embodiment of the present invention.

Refer to FIG. 6A and FIG. 6B, which show schematic views of the deformed reinforcing bar of the present invention. As shown in FIG. 6B, the deformed reinforcing bar is formed by a hot rolled process, comprising: a long steel bar (50), roughly round shape in cross-section, disposed with a groove (11*b*、12*b*) on circumference (30) of the steel bar (50) along length direction; moreover, as shown in FIG. 6A, the deformed reinforcing bar is formed by a hot rolled process, comprising: a long steel bar (50), roughly round shape in cross-section, disposed with a plurality of troughs (11*a*、12*a*) on circumference (30) of the steel bar (50) along length direction. The troughs and the groove having a structure, width and depth matching with an outer diameter of the strut member and matching with a welding process used for constructing the truss structure. The deformed reinforcing bar has a plurality of transverse ribs (41) or concave marks on surface (21) of the steel bar (50) along length direction and separated with intervals and on surface of the accommodating recess (i.e., the troughs or the groove). Also, a protruding rounded chamfer (r2) is disposed at between each of two edges of the accommodating recess and the outer surface (21) of the long steel bar (50), and two longitudinal ribs (42) are disposed at opposite sides on the surface (21) of the steel bar (50) along length direction.

FIG. 1A to FIG. 4B show the cross-sectional views of a variety of embodiments based on the deformed reinforcing bars shown in FIG. 6A and FIG. 6B.

First Embodiment of Deformed Reinforcing Bar

Figure 1B:
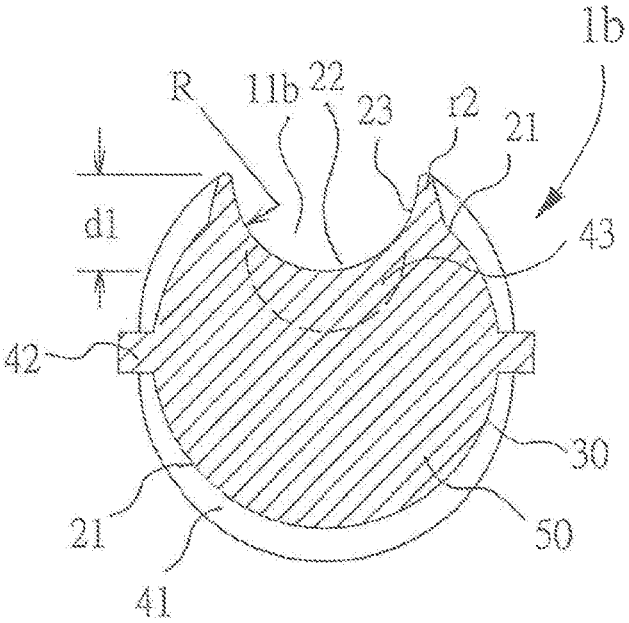
FIG. 1B shows a cross-sectional view along 1B-1B direction of the deformed reinforcing bar in accordance with the first embodiment of the present invention.

FIG. 1B shows a cross-sectional view along 1B-1B direction of the deformed reinforcing bar (1*b*) in accordance with the first embodiment of the present invention. As shown in FIG. 1B, the deformed reinforcing bar (1*b*) is formed by a hot rolled process, comprising: a long steel bar (50), roughly round shape in cross-section, disposed with a groove (11*b*) on circumference (30) of the steel bar (50) along length direction, and the cross-section of the groove (11*b*) has an arc shape. The radius (R) of the groove (11*b*) is equal to or slightly larger than a radius of the strut member with which the deformed reinforcing bar (1*b*) will match to assemble to form a truss structure, which will be described later. The depth (d1) of the groove (11*b*) must be equal to or less than the radius of the strut member. Moreover, the deformed reinforcing bar (1*b*) has a plurality of transverse ribs (41) or concave marks on surface (21) of the steel bar (50) along length direction and separated with intervals, and a plurality of concave marks (43) is disposed on surface (22) of the groove (11*b*) along length direction and separated with intervals. In addition, a protruding rounded chamfer (r2) is disposed at between each of two edges (23) of the groove (11*b*) and the outer surface (21) of the long steel bar (50), and two longitudinal ribs (42) are disposed at opposite sides on the surface (21) of the steel bar (50) along length direction.

Second Embodiment of Deformed Reinforcing Bar

Figure 10B:
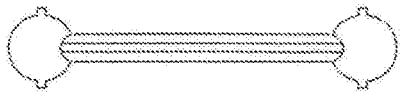
FIG. 10A and FIG. 10B show a top and front view of fitting the strut member into the two deformed reinforcing bars with a plurality of troughs in accordance with an embodiment of the present invention.
Figure 10A:
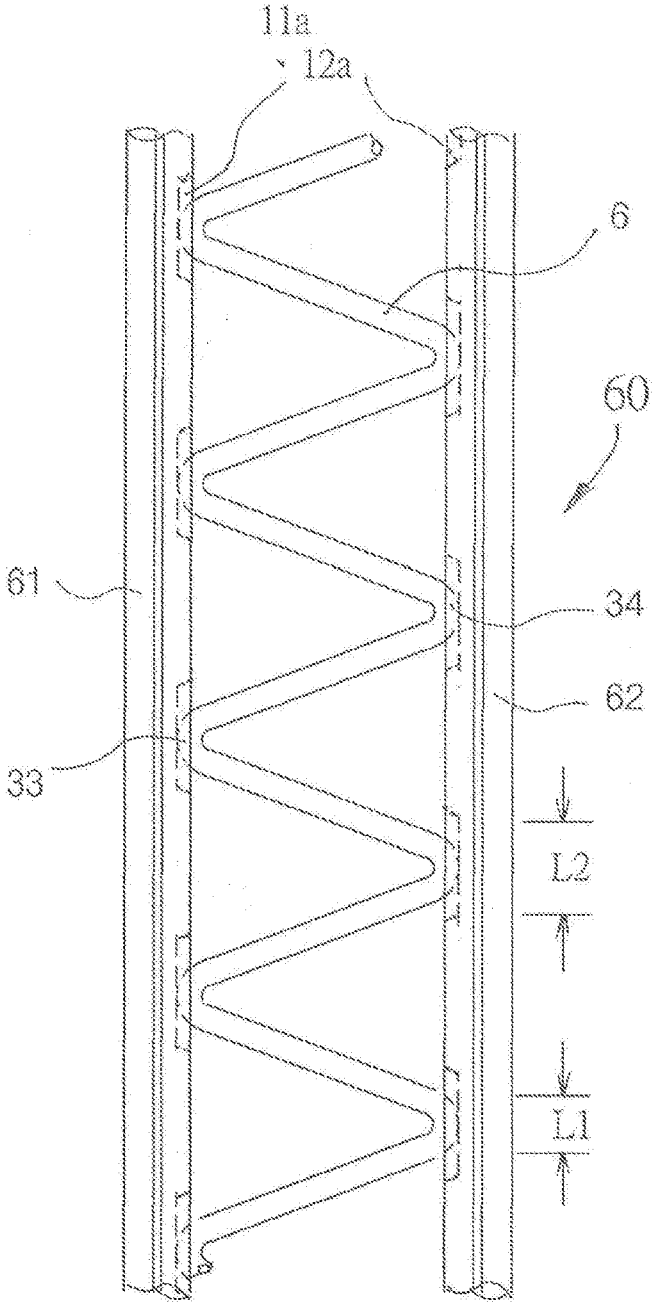
Figure 10D:
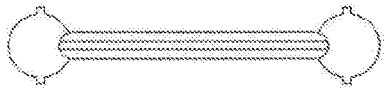
FIG. 10C and FIG. 10D show a top and front view of fitting the strut member into the two deformed reinforcing bars with a groove in accordance with an embodiment of the present invention.

FIG. 1A shows a cross-sectional view along 1A-1A direction of the deformed reinforcing bar (1*a*) in accordance with the second embodiment of the present invention. As shown in FIG. 1A, the deformed reinforcing bar (1*a*) is formed by a hot rolled process, comprising: a long steel bar (50), roughly round shape in cross-section, disposed with a plurality of troughs (11*a*) arranged in a line and separated with intervals on circumference (30) of the steel bar (50) along length direction, and the cross-section of the troughs (11*a*) has an arc shape. The radius (R) of the troughs (11*a*) is equal to or slightly larger than a radius of the strut member with which the deformed reinforcing bar (1*a*) will match to assemble to form a truss structure, which will be described later. The depth (d1) of the troughs (11*a*) must be equal to or less than the radius of the strut member. Moreover, the deformed reinforcing bar (1*a*) has a plurality of transverse ribs (41) or concave marks on surface (21) of the steel bar (50) along length direction and separated with intervals, In addition, a protruding rounded chamfer (r2) is disposed at between each of two edges (23) of the troughs (11*a*) and the outer surface (21) of the long steel bar (50), and two longitudinal ribs (42) are disposed at opposite sides on the surface (21) of the steel bar (50) along length direction. Refer to FIGS. 10A and 10B show top and front views of fitting the strut member into the two deformed reinforcing bars with a plurality of troughs (11*a*) to construct a truss structure (60) in accordance with an embodiment of the present invention. The deformed reinforcing bars are used as a top chord (61) and a bottom chord (62) of the truss structure (60). Each trough (11*a*) has a longitude length (L2) larger than the longitude length (L1) of contact part (33, 34) of the bending regions of the strut member (6). The cross-section area of the second embodiment of the deformed reinforcing bar (1*a*) roughly stays unchanged throughout the entire length.

Third Embodiment of Deformed Reinforcing Bar

Figure 2A:
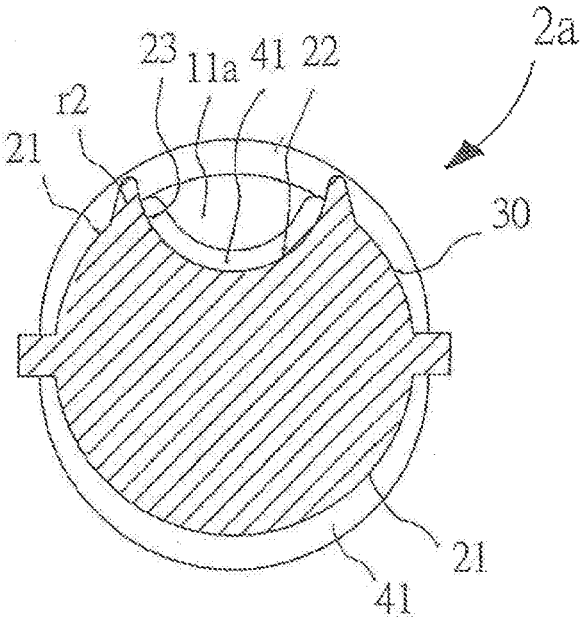
FIG. 2A shows a cross-sectional view of the deformed reinforcing bar in accordance with the fourth embodiment of the present invention.
Figure 2B:
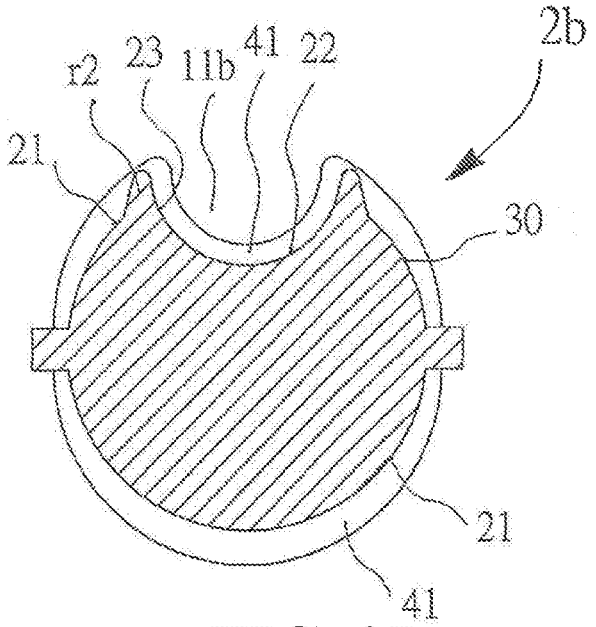
FIG. 2B shows a cross-sectional view of the deformed reinforcing bar in accordance with the third embodiment of the present invention.

FIG. 2B shows a cross-sectional view of the deformed reinforcing bar (2*b*) in accordance with the third embodiment of the present invention. The third embodiment is a variation based on the first embodiment, with the difference that, in FIG. 2B, a plurality of transverse ribs (41) is disposed at the surface (22) of the arc-shaped groove (11*b*) along the length direction and separated with intervals.

Fourth Embodiment of Deformed Reinforcing Bar

FIG. 2A shows a cross-sectional view of the deformed reinforcing bar (2*a*) in accordance with the fourth embodiment of the present invention. The fourth embodiment is a variation based on the second embodiment, with the difference that, in FIG. 2A, a plurality of transverse ribs (41) is disposed at the surface (22) of the arc-shaped troughs (11*a*) along the length direction and separated with intervals.

Fifth Embodiment of Deformed Reinforcing Bar

Figure 3A:
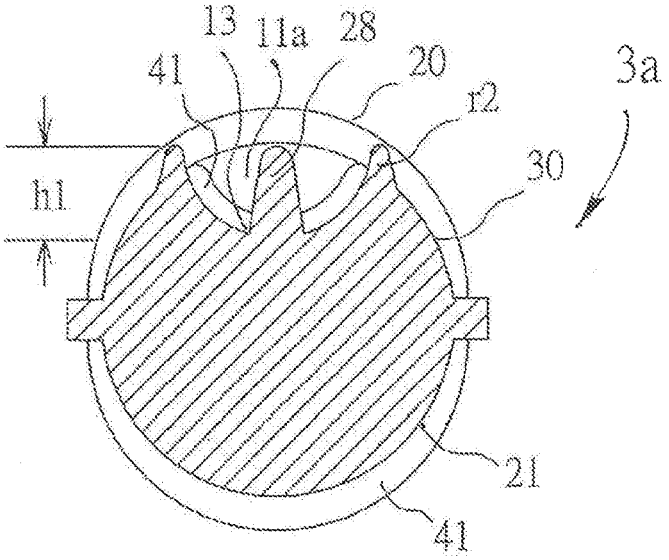
FIG. 3A shows a cross-sectional view of the deformed reinforcing bar in accordance with the sixth embodiment of the present invention.
Figure 3B:
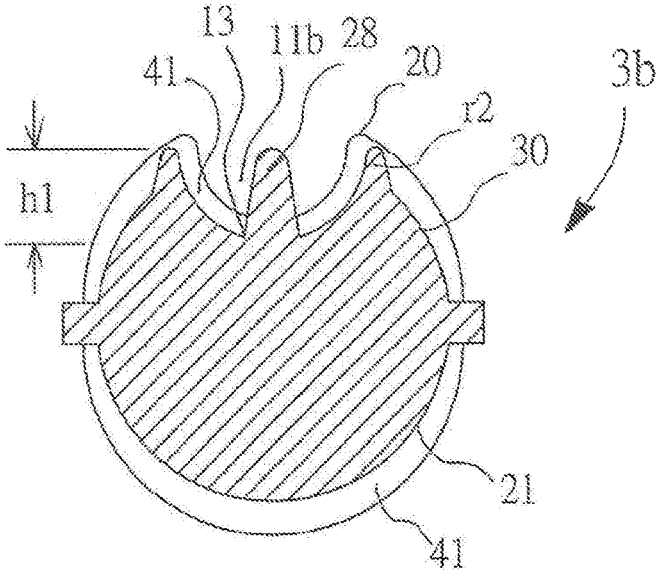
FIG. 3B shows a cross-sectional view of the deformed reinforcing bar in accordance with the fifth embodiment of the present invention.

FIG. 3B shows a cross-sectional view of the deformed reinforcing bar (3*b*) in accordance with the fifth embodiment of the present invention. The fifth embodiment is a variation based on the third embodiment, with the difference that, in FIG. 3B, having at least one continuous convex strip (28) or a plurality of discontinuous convex strips (28) along the length direction is disposed at the bottom (13) of the arc-shaped groove (11*b*), and the convex strips (28) extend in a direction parallel to or form a tilt angle with the length of the deformed reinforcing bar (3*b*). The convex strips (28) have a height (h1) equal to or less than the maximum outer diameter (20) of the deformed reinforcing bar (3*b*), and have a maximum thickness of 5 mm.

Sixth Embodiment of Deformed Reinforcing Bar

FIG. 3A shows a cross-sectional view of the deformed reinforcing bar (3*a*) in accordance with the sixth embodiment of the present invention. The sixth embodiment is a variation based on the fourth embodiment, with the difference that, in FIG. 3A, having at least one continuous convex strip (28) or a plurality of discontinuous convex strips (28) along the length direction is disposed at the bottom (13) of the arc-shaped troughs (11*a*), and the convex strips (28) extend in a direction parallel to or form a tilt angle with the length of the deformed reinforcing bar (3*a*). The convex strips (28) have a height (h1) equal to or less than the maximum outer diameter (20) of the deformed reinforcing bar (3*a*), and have a maximum thickness of 5 mm.

Seventh Embodiment of Deformed Reinforcing Bar

Figure 4A:
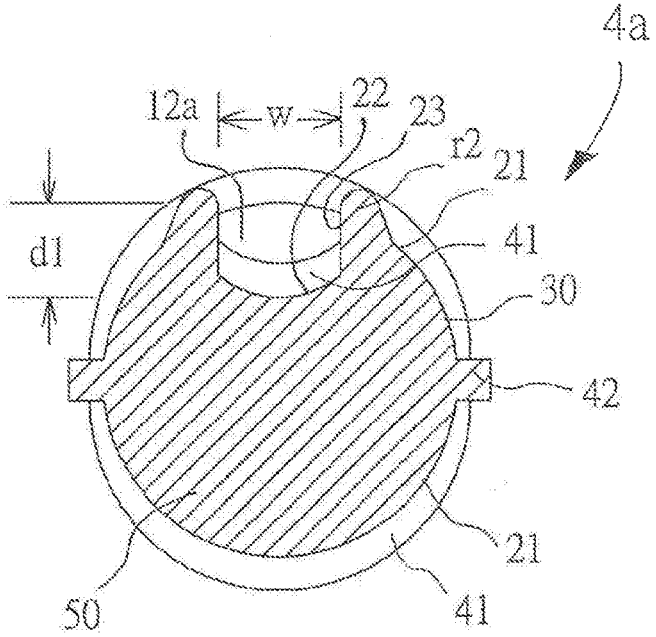
FIG. 4A shows a cross-sectional view along 4A-4A direction of the deformed reinforcing bar in accordance with the eighth embodiment of the present invention.
Figure 4B:
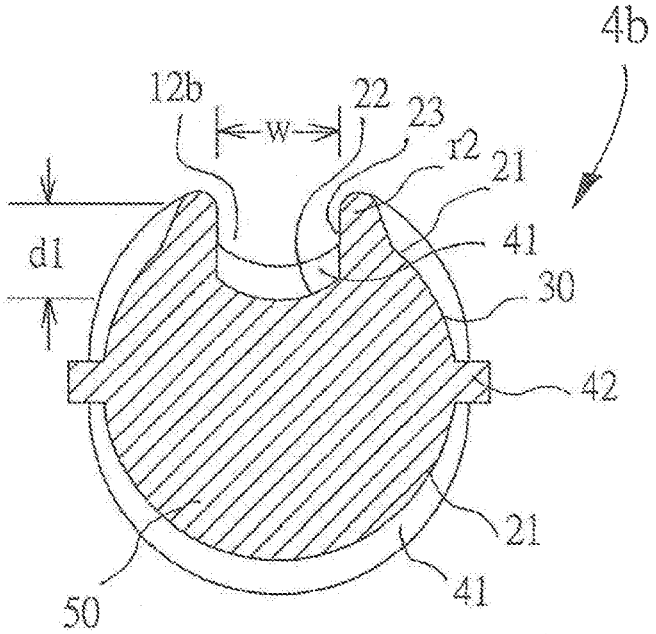
FIG. 4B shows a cross-sectional view along 4B-4B direction of the deformed reinforcing bar in accordance with the seventh embodiment of the present invention.

FIG. 4B shows a cross-sectional view along 4B-4B direction of the deformed reinforcing bar (4*b*) in accordance with the seventh embodiment of the present invention. As shown in FIG. 4B, the deformed reinforcing bar (4*b*) is formed by a hot rolled process, comprising: a long steel bar (50), roughly round shape in cross-section, disposed with a groove (12*b*) on circumference (30) of the steel bar (50) along length direction, and the cross-section of the groove (12*b*) has an U-shape. The width (w) of the U-shaped groove (12*b*) is between the diameter and the radius of the strut member with which the deformed reinforcing bar (4*b*) will match to assemble to form a truss structure, which will be described later. The depth (d1) of the groove (12*b*) must be equal to or less than the radius of the strut member. Moreover, the deformed reinforcing bar (4*b*) has a plurality of transverse ribs (41) or concave marks on surface (21) of the steel bar (50) and on surface (22) of the U-shaped groove (12*b*) along length direction and separated with intervals. In addition, a protruding rounded chamfer (r2) is disposed at between each of two edges (23) of the groove (12*b*) and the outer surface (21) of the long steel bar (50), and two longitudinal ribs (42) are disposed at opposite sides on the surface (21) of the steel bar (50) along length direction. The seventh embodiment also comprises at least one continuous convex strip or a plurality of discontinuous convex strips along the length direction is disposed at the bottom of the U-shaped groove (12*b*), and the convex strips extend in a direction parallel to or form a tilt angle with the length of the deformed reinforcing bar (4*b*). The convex strips have a height equal to or less than the maximum outer diameter of the deformed reinforcing bar (4*b*), and have a maximum thickness of 5 mm.

Eighth Embodiment of Deformed Reinforcing Bar

FIG. 4A shows a cross-sectional view along 4A-4A direction of the deformed reinforcing bar (4*a*) in accordance with the eighth embodiment of the present invention. As shown in FIG. 4A, the deformed reinforcing bar (4*a*) is formed by a hot rolled process, comprising: a long steel bar (50), roughly round shape in cross-section, disposed with a plurality of troughs (12*a*) arranged in a line and separated with intervals on circumference (30) of the steel bar (50) along length direction, and the cross-section of the troughs (12*a*) has an U-shape. The width (w) of the U-shaped trough (12*a*) is between the diameter and the radius of the strut member with which the deformed reinforcing bar (4*a*) will match to assemble to form a truss structure, which will be described later. The depth (d1) of the trough (12*a*) must be equal to or less than the radius of the strut member. Moreover, the deformed reinforcing bar (4*a*) has a plurality of transverse ribs (41) or concave marks on surface (21) of the steel bar (50) and on surface (22) of the U-shaped trough (12*a*) along length direction and separated with intervals. In addition, a protruding rounded chamfer (r2) is disposed at between each of two edges (23) of the trough (12*a*) and the outer surface (21) of the long steel bar (50), and two longitudinal ribs (42) are disposed at opposite sides on the surface (21) of the steel bar (50) along length direction. The eighth embodiment also comprises at least one continuous convex strip or a plurality of discontinuous convex strips along the length direction is disposed at the bottom of the U-shaped trough (12*a*), and the convex strips extend in a direction parallel to or form a tilt angle with the length of the steel bar (50). The convex strips have a height equal to or less than the maximum outer diameter of the deformed reinforcing bar (4*a*), and have a maximum thickness of 5 mm.

Ninth Embodiment of Deformed Reinforcing Bar

Figure 5A:
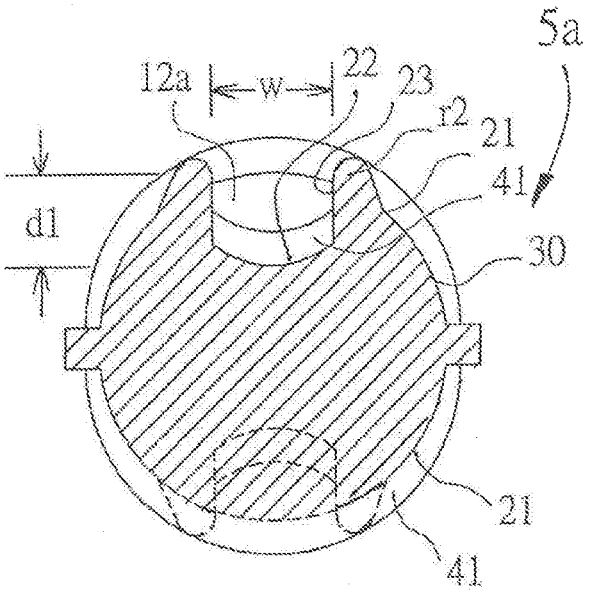
FIG. 5A shows a cross-sectional view along 5A-5A direction of the deformed reinforcing bar in accordance with the tenth embodiment of the present invention.
Figure 5B:
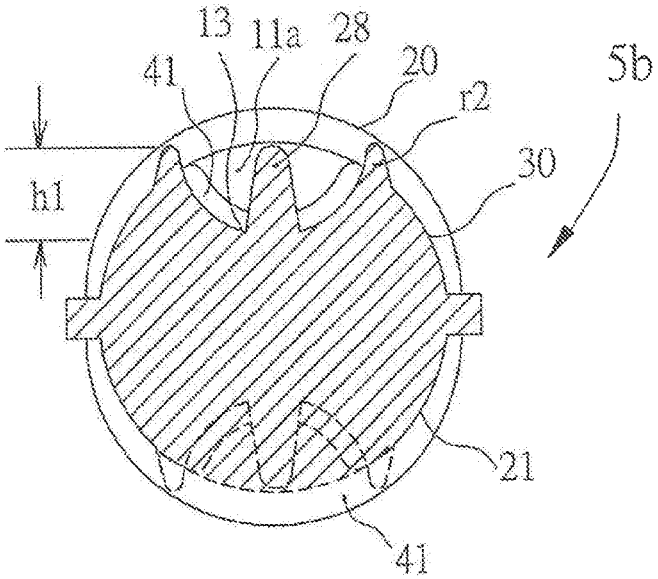
FIG. 5B shows a cross-sectional view along 5B-5B direction of the deformed reinforcing bar in accordance with the ninth embodiment of the present invention.
Figure 6C:
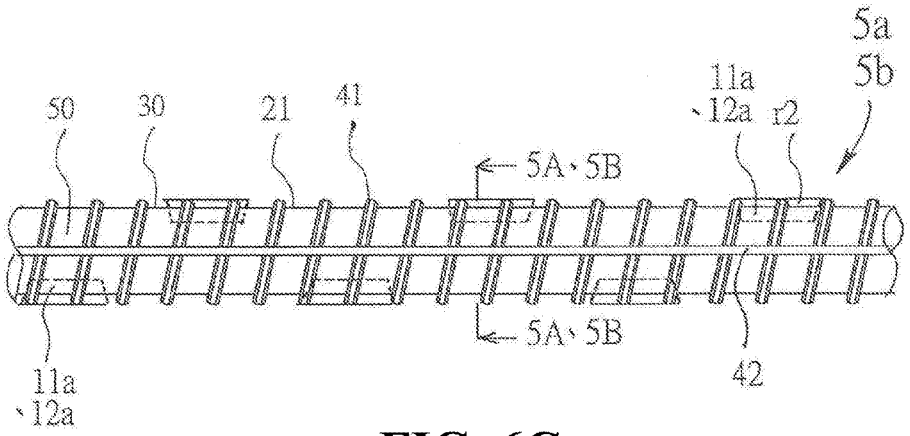
FIG. 6C shows a schematic view of two sets of a plurality of troughs arranged in a line at the two opposite sides along the length direction on circumference of the deformed reinforcing bar in accordance with an embodiment of the present invention.

Refer to FIG. 6C and FIG. 5B, FIG. 5B shows a cross-sectional view along 5B-5B direction of the deformed reinforcing bar (5*b*) in accordance with the ninth embodiment of the present invention. The ninth embodiment is a variation of the sixth embodiment shown in FIG. 3A. Specifically, as shown in FIG. 5B, the deformed reinforcing bar (5*b*) is disposed with a plurality of second troughs (11*a*) arranged in a line and separated with intervals on circumference (30) of the long steel bar and at opposite side (180° apart) of the plurality of troughs of the accommodating recess; the second trough (11*a*) has the same structure as the troughs of the accommodating recess. Refer to FIG. 6C, the troughs of the accommodating recess and the plurality of second troughs are not aligned along the length.

Tenth Embodiment of Deformed Reinforcing Bar

Refer to FIG. 6C and FIG. 5A, FIG. 5A shows a cross-sectional view along 5A-5A direction of the deformed reinforcing bar (5*a*) in accordance with the tenth embodiment of the present invention. The tenth embodiment is a variation of the eighth embodiment shown in FIG. 4A. Specifically, as shown in FIG. 5A, the deformed reinforcing bar (5*a*) is disposed with a plurality of second troughs (12*a*) arranged in a line and separated with intervals on circumference (30) of the long steel bar and at opposite side (180° apart) of the plurality of troughs of the accommodating recess; the second troughs (12*a*) has the same structure as the troughs of the accommodating recess. Refer to FIG. 6C, the troughs of the accommodating recess and the plurality of second troughs (12*a*) are not aligned along the length.

Embodiment of Truss Structure

Figure 7A:
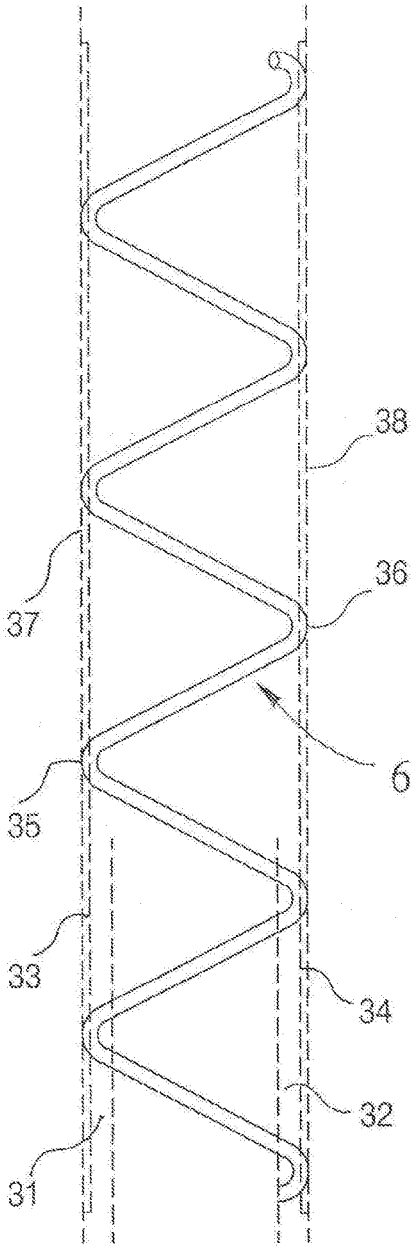
FIG. 7A and FIG. 7B show schematic views of various forms of the strut member of the truss structure in accordance with an embodiment of the present invention.
Figure 7B:
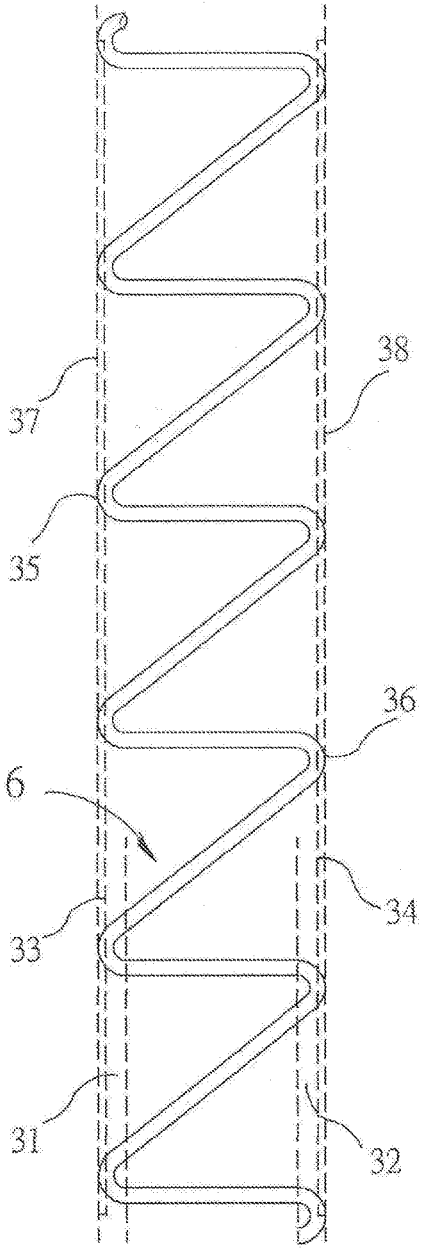
Figure 10C:
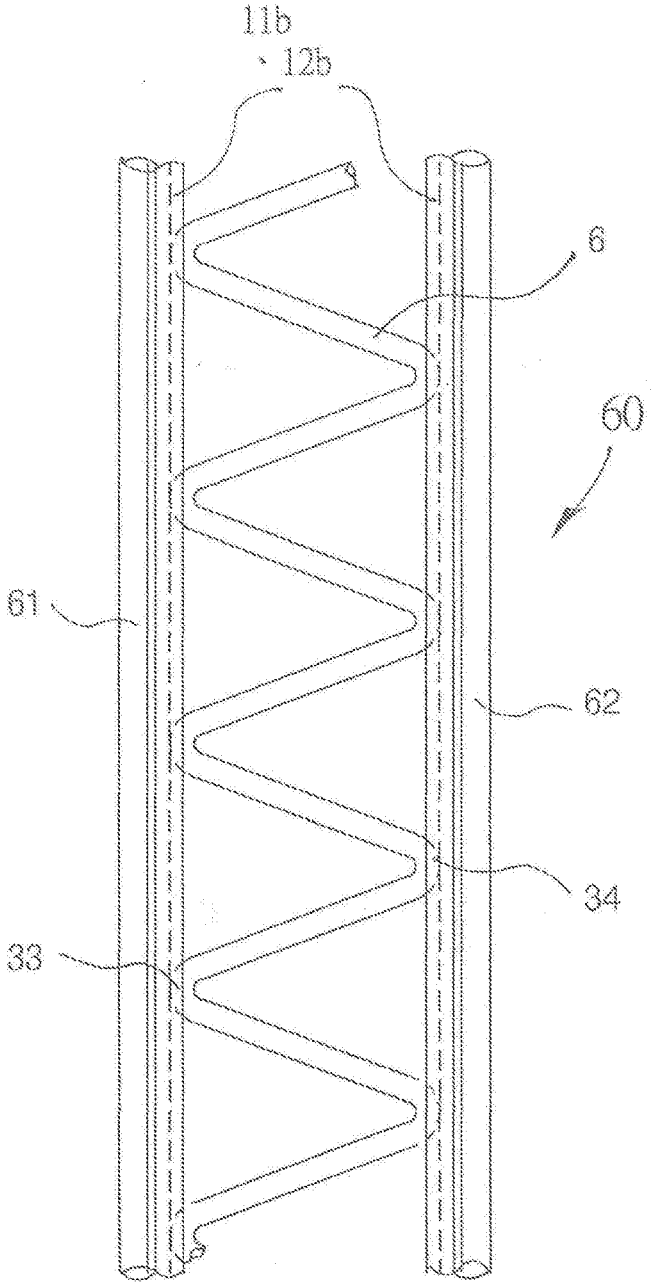

The truss structure of the present invention uses the deformed reinforcing bar shown in FIG. 1A to FIG. 5B. Refer to FIG. 10A (60) and FIG. 10C (60), wherein a strut member (6) is formed by bending a conventional reinforcing bar into a wavy shape (i.e., zigzag), as shown in FIG. 7A (6) and FIG. 7B (6), with a plurality of bending regions (31, 32) along length direction. The bending region (31, 32) of the strut member (6) comprises a contact part (33, 34) having an outer vertexes (35, 36). That is, the outer vertexes (35, 36) of the bending regions (31, 32) roughly form two parallel lines (37, 38) on the same plane.

Moreover, the wavelength (i.e., the distance between two successive bending regions) stays roughly unchanged.

Figure 8A:
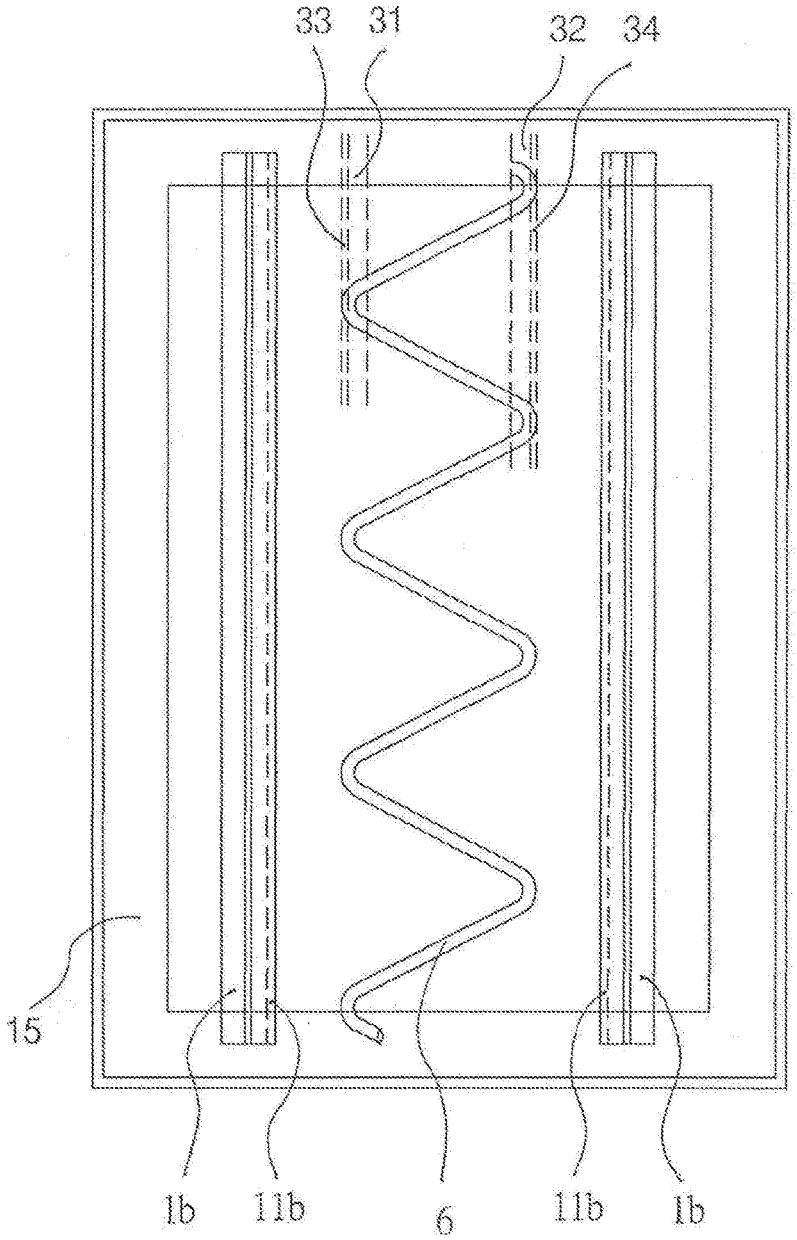
FIG. 8A and FIG. 8B show a top and front view of a combination of two deformed reinforcing bars and a strut member in accordance with an embodiment of the present invention.
Figure 8B:
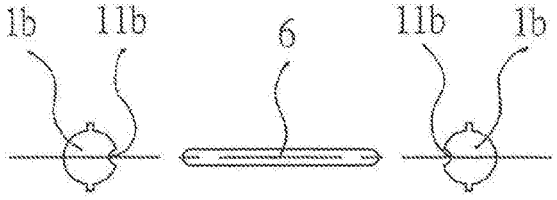
Figure 12A:
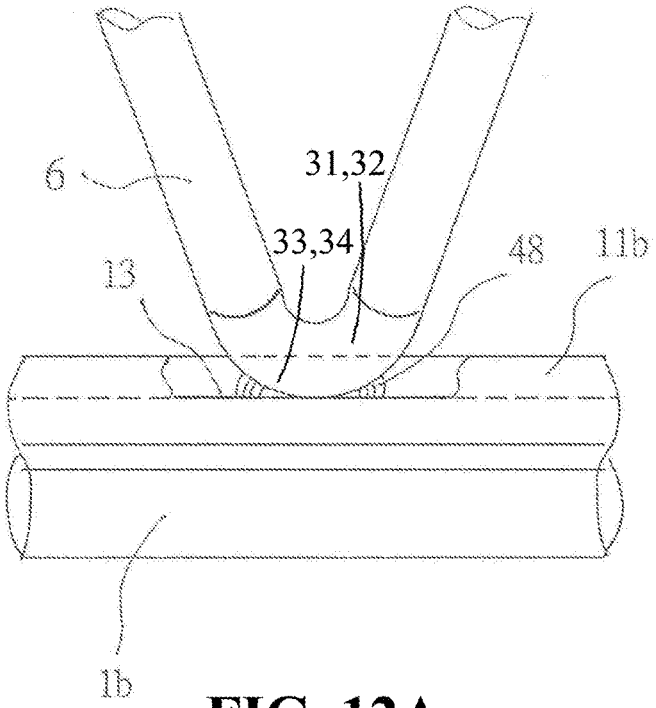
FIG. 12A and FIG. 12A' show front and side views of fitting the strut member into accommodating recess of the deformed reinforcing bar in accordance with an embodiment of the present invention.
Figure 12A:
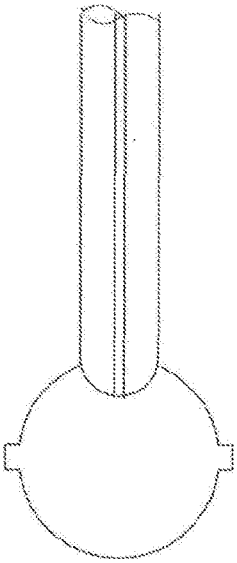
Figure 12B:
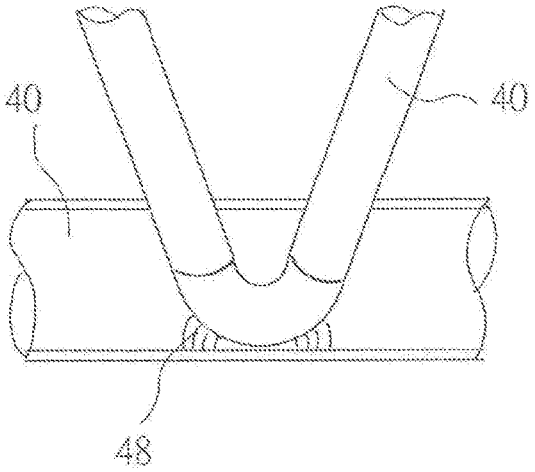
FIG. 12B and FIG. 12B' show front and side views of a conventional attaching the support reinforcement bar to the upper/lower chord in a conventional truss structure.
Figure 12B:
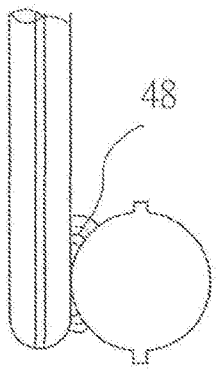
Figure 12C:
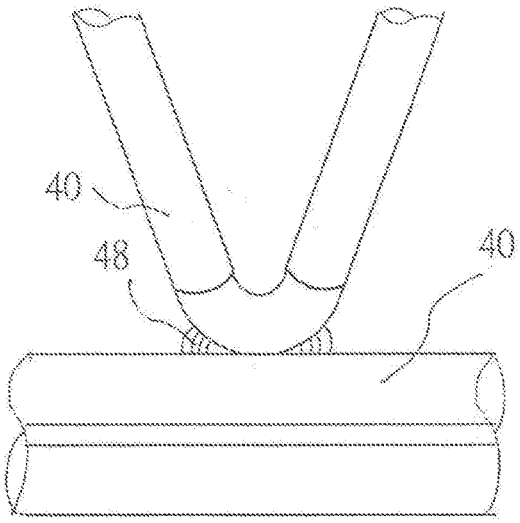
FIG. 12C and FIG. 12C' show front and side views of a conventional attaching the support reinforcement bar to the upper/lower chord in another conventional truss structure.
Figure 12C:
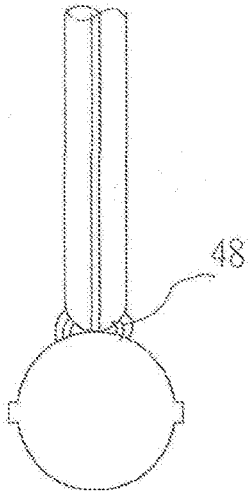
Figure 13:
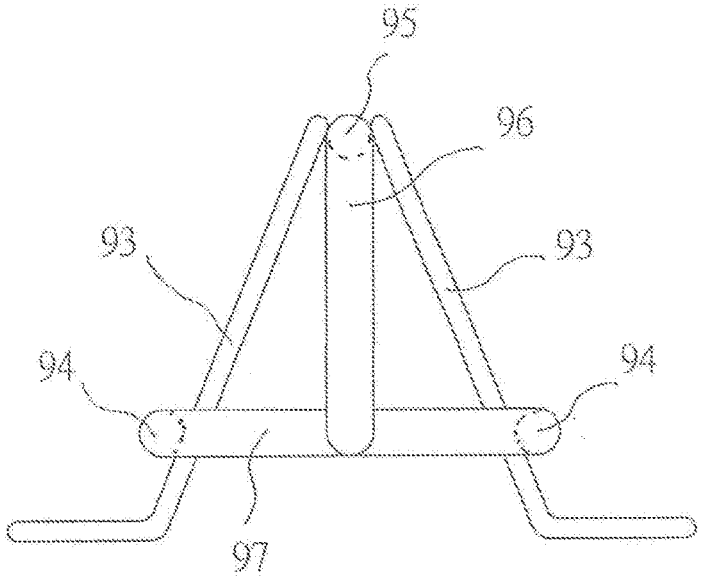
FIG. 13 shows a schematic view of a conventional triangular truss structure.
Figure 14:
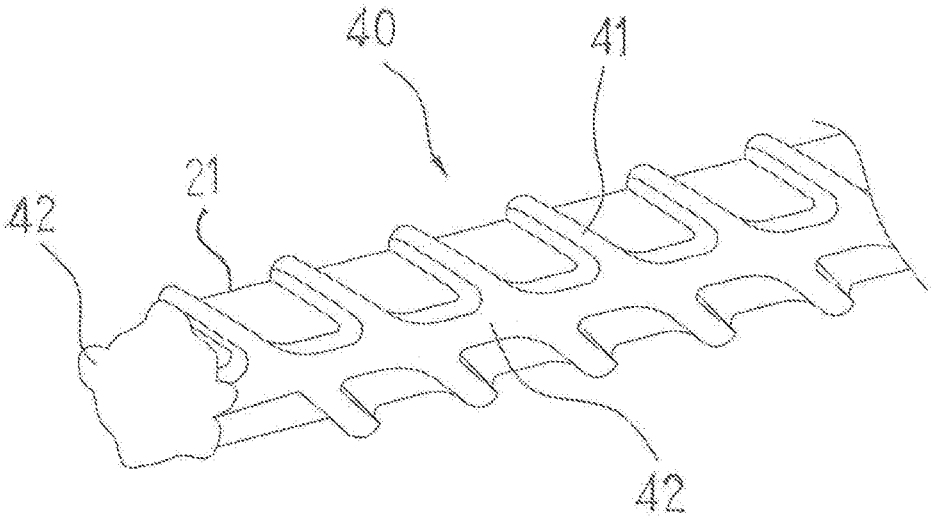
FIG. 14 shows a schematic view of a conventional reinforcing bar.

When using the deformed reinforcing bars of the first or second embodiments of the present invention to manufacture the truss structure (60), the process of assembling the top chord (61), the bottom chord (62) and the strut member (6) is shown in FIG. 8A and FIG. 8B, A deformed reinforcing bar (1*b*) of the first embodiment is used as the top chord (61) and is placed on a clamping frame (15). Then, a strut member (6) is fitted into the groove (11*b*) of the deformed reinforcing bar (1*b*). The fitting implies to insert all the contact parts (33) of the bending regions (31) into the groove (11*b*). Then, another deformed reinforcing bar (1*b*) of the first embodiment is used as the bottom chord (62), and the strut member (6) is fitted into the groove (11*b*) of the deformed reinforcing bar (1*b*). That is, the all the contact parts (34) of the bending regions (32) are fitted into the groove (11*b*). Finally, a welding process is employed to weld the strut member (6) to the top chord and the bottom chord at two ends, middle and/or other appropriate positions to construct the truss structure. The welding process is performed on the contact part (33, 34) of the bending region (31, 32) to the bottom (13) of the groove (11*b*) of the deformed reinforcing bar (1*b*), as shown in FIG. 12A (as opposed to FIG. 12B, FIG. 12C for conventional reinforcing bars (40)). The truss structure assembled by the above process can be used in manufacturing pre-assembled hollow walls, floor modules, beams, and other construction modules.

The truss structure assembled by using the deformed reinforcing bars of the first or second embodiments of the present invention provides the following advantages:

1. The welding process becomes easier.
2. The welding is selectively performed at the bottom (13) of the accommodating recess and the contact part (33, 34) of the bending region (31, 32), which shortens the schedule and reduces cost.
3. The weld point (48) will not break off easily during pouring concrete, and the strength of the product is ensured.
4. The quality consistency will be easier to achieve.

Figure 9A:
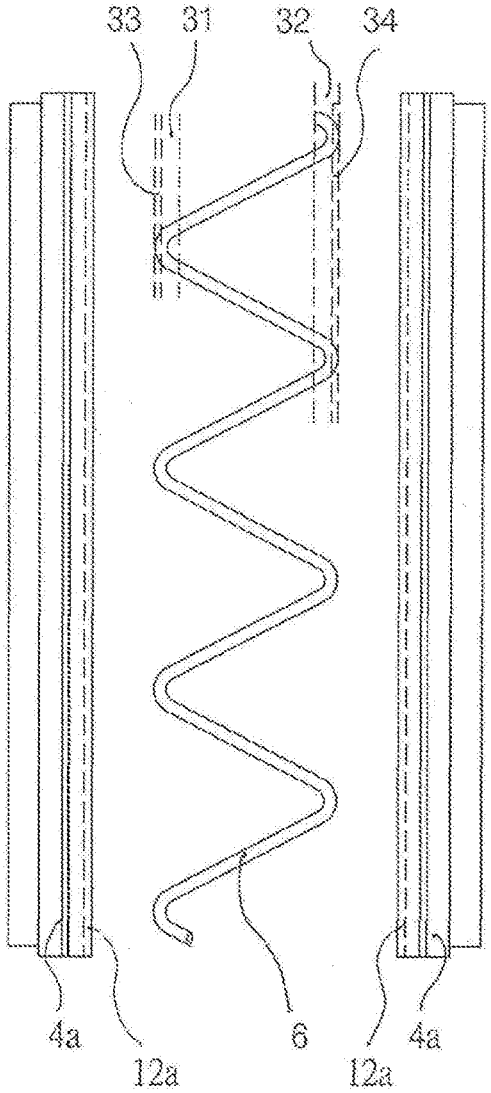
FIG. 9A and FIG. 9B show a top and front view of a combination of two deformed reinforcing bars and a strut member in accordance with another embodiment of the present invention.
Figure 9B:
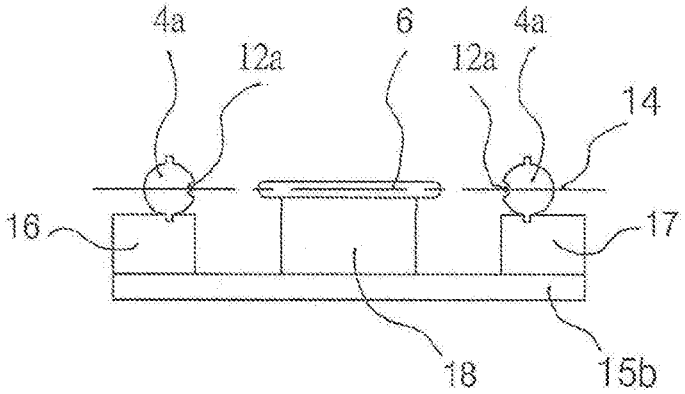

The following uses the deformed reinforcing bar (4*a*) of the eighth embodiment as an example for describe the truss structure construction with the remaining embodiments of the deformed reinforcing bars of the present invention. The process is as shown in FIG. 9A and FIG. 9B which is performed on a specialized assembly workstation (15*b*) for truss structure based on resisting welding. The workstation comprises a left and a right linear sliders (16, 17), and a clamping platform (18) in the middle. The characteristic of the workstation is to have the top chord, the bottom chord and the strut member all at the same level (14). The strut member (6) is placed on the clamping platform (18), and a deformed reinforcing bar (4*a*) of the eighth embodiment are placed on the left and the right linear sliders (16, 17) respectively. The position of the deformed reinforcing bar (4*a*) of the eighth embodiment on the left and the right linear sliders (16, 17) is adjusted respectively so that the troughs (12*a*) face the strut member (6). After fixing each part to the respective slider and platform, the power is turned on so that the deformed reinforcing bar (4*a*) of the eighth embodiment move towards the strut member (6) sequentially to contact. A large current flows through, and the contact point starts to melt by the generated high temperature and becomes welded. As such, the contact part (33, 34) of the bending region (31, 32) of the strut member (6) are fitted into the troughs (12*a*) of the deformed reinforcing bars (4*a*) of the eighth embodiment and fixed between the two deformed reinforcing bars (4*a*) of the eighth embodiment. Finally, the power is turned off to accomplish constructing a truss structure.

In the above assembly process, the contact area between the deformed reinforcing bar (4*a*) of the eighth embodiment and the strut member (6) is small, the conductive area for the current and the heat of the deformed reinforcing bar (4*a*) of the eighth embodiment is also small, and the welded portion has strips to reduce volume. As such, only a small power current is needed to achieve the high quality resisting welding process. Moreover, the contact part (33, 34) of the bending region (31, 32) of the strut member (6) are fitted into the troughs (12*a*) of the deformed reinforcing bar (4*a*) of the eighth embodiment and fixed to become durable truss structure. As a result, the disadvantages in conventional reinforcing bar (40) as well as truss structure with the convention reinforcing bar (40) as top chord and bottom chord is prevented.

In addition, with the strips of the eighth embodiment disposed at the welding parts, the assembly can be easily performed to achieve high quality truss structure even when the diameters of the top chord and bottom chord are large different from the diameter of the strut member. During resist welding, the high temperature is constrained to the strips portion of the top chord and the bottom chord, while the temperature at the other parts of the long steel bar (50) does not reach critical point to affect the metal microstructure and strength of mechanical.

Embodiment of Floor Module Structure

Figure 11:
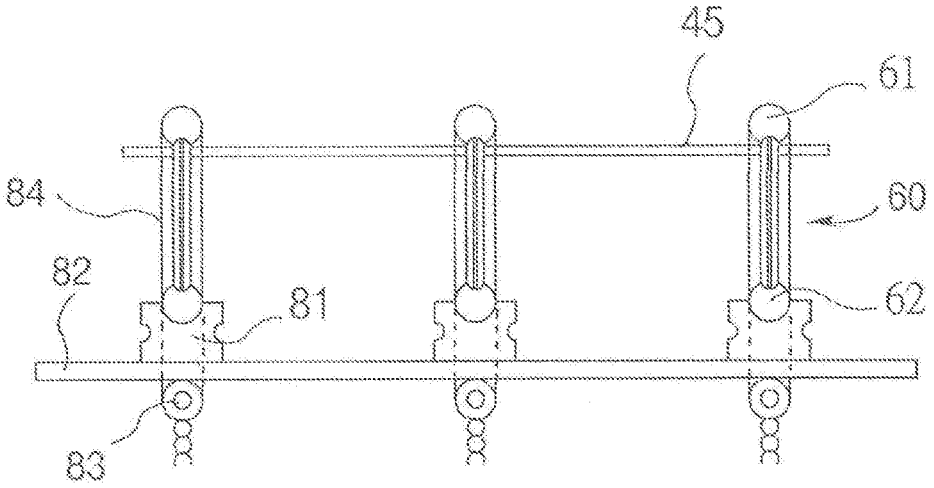
FIG. 11 shows a schematic view of the floor module structure using the truss structure in accordance with an embodiment of the present invention.

FIG. 11 shows a schematic view of the floor module structure using the truss structure in accordance with an embodiment of the present invention. The floor module structure of the present invention, applicable to a pre-assembled construction process, comprises: a plurality of horizontal fixed steel bars (45), a plurality of wrapping wires (84), a bottom template (82), and a plurality of truss structures (60) perpendicularly disposed on the bottom template, arranged in parallel and separated with intervals along a vertical direction; wherein each of the truss structures (60) being as described earlier; a plurality of interval blocks (81) being disposed between each truss structure (60) and the bottom template (82) along the vertical direction and separated with intervals; a long reinforcement element (83) being disposed in vertical direction beneath the bottom template (82) at location corresponding to the truss structure (60); the wrapping wires (84) being disposed to penetrate the bottom template (82) to fasten the top chord (61) of the truss structure (60) and the corresponding long reinforcement element (83); the horizontal fixed steel bars (45) being disposed to set through under the top chord (61) of the truss structure at two ends and the middle of the floor module structure, and welded or tied to fasten the horizontal fixed steel bars (45) to the top chord (61) to accomplish the assembly of the floor module structure as shown in FIG. 11.

It should be noted that the interval blocks (81) can be concrete blocks, and arranged in rows. The bottom template (82) can be a plywood with thickness of 15±5 mm, and drilled with holes at corresponding locations for the wrapping wires to pass through. The long reinforcement element (83) can be a thick steel tube or T-shaped enhanced steel rod, disposed below the bottom plate at location corresponding to the truss structure (60).

The above pre-assembled floor module structure can be shipped to the construction site to save construction time and cost. For assembling the floor module structure into a floor, a lateral reinforcing bar (40) is disposed above the bottom chords (62) to connect a plurality of floor module structures.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A truss structure, comprising:

a strut member, being a reinforcing bar bended at intervals into a zigzag wave shape with a plurality of bending regions, the bending regions having outer vertices defining two parallel lines that intersect only the vertices;

a top chord and a bottom chord, fixed to the outer vertices of the bending regions of the strut member;

wherein the top chord and the bottom chord are a deformed reinforcing bar respectively, formed by a hot rolled process, and the deformed reinforcing bar comprises: a long steel bar, substantially round shape in cross-section, disposed with an accommodating recess on a circumference of the steel bar along a length direction, the accommodating recess has a structure, width and depth matching with an outer diameter of the strut member and enables an employment of a welding process to construct the truss structure;

the deformed reinforcing bar has a plurality of transverse ribs on a surface of the steel bar along the length direction and separated with intervals, and a surface of the accommodating recess has a plurality of concave marks along the length direction and separated with intervals; a protruding rounded chamfer is disposed between each of two edges of the accommodating recess and the surface of the long steel bar;

wherein the strut member has bending regions along the length direction fitted into the accommodating recess of the deformed reinforcing bar and welded to construct the truss structure.

2. The truss structure as claimed in claim 1, wherein the accommodating recess of the deformed reinforcing bar comprises a continuous groove.

3. The truss structure as claimed in claim 1, wherein the accommodating recess of the deformed reinforcing bar comprises a plurality of troughs arranged in a line and separated with intervals.

4. The truss structure as claimed in claim 1, wherein the surface of the steel bar is further disposed with a plurality of concave marks along the length direction and separated with intervals.

5. The truss structure as claimed in claim 1, wherein the surface of the accommodating recess is further disposed with a plurality of transverse ribs along the length direction and separated with intervals.

6. The truss structure as claimed in claim 1, wherein a bottom of the accommodating recess of the deformed reinforcing bar is further disposed with at least one continuous convex strip or a plurality of discontinuous convex strips along the length direction, and the at least one continuous convex strip or the plurality of discontinuous convex strips extend in a direction parallel to or form a tilt angle with the length of the deformed reinforcing bar.

7. The truss structure as claimed in claim 3, wherein the deformed reinforcing bar has a cross-sectional area substantially stays unchanged at any location along the length direction.

8. The truss structure as claimed in claim 3, wherein a plurality of second troughs arranged in a line and separated with intervals is disposed on the circumference of the long steel bar and at opposite side of the plurality of troughs of the accommodating recess; the second trough has the same structure as the troughs of the accommodating recess; the troughs of the accommodating recess and the plurality of second troughs are not aligned along the length.

9. A deformed reinforcing bar, formed by a hot rolled process and applicable as a top chord or a bottom chord to a truss structure, wherein the truss structure further comprises a strut member fixed to the top chord and the bottom chord, the deformed reinforcing bar comprises a long steel bar, substantially round shape in cross-section, disposed with an accommodating recess on a circumference of the steel bar along a length direction, the accommodating recess has a structure, width and depth matching with an outer diameter of the strut member and enables an employment of a welding process to construct the truss structure; the deformed reinforcing bar has a plurality of transverse ribs on a surface of the steel bar along the length direction and separated with intervals, and a surface of the accommodating recess has a plurality of concave marks along the length direction and separated with intervals; a protruding rounded chamfer is disposed between each of two edges of the accommodating recess and the surface of the long steel bar.

10. The deformed reinforcing bar as claimed in claim 9, wherein the accommodating recess comprises a continuous groove.

11. The deformed reinforcing bar as claimed in claim 9, wherein the accommodating recess comprises a plurality of troughs arranged in a line and separated with intervals.

12. The deformed reinforcing bar as claimed in claim 9, wherein the surface of the steel bar is further disposed with a plurality of concave marks along the length direction and separated with intervals.

13. The deformed reinforcing bar as claimed in claim 9, wherein the surface of the accommodating recess is further disposed with a plurality of transverse ribs along the length direction and separated with intervals.

14. The deformed reinforcing bar as claimed in claim 9, wherein bottom of the accommodating recess is further disposed with at least one continuous convex strip or a plurality of discontinuous convex strips along the length direction, and the at least one continuous convex strip or the plurality of discontinuous convex strips extend in a direction parallel to or form a tilt angle with the length of the deformed reinforcing bar.

15. The deformed reinforcing bar as claimed in claim 11, wherein the deformed reinforcing bar has a cross-sectional area substantially stays unchanged at any location along the length direction.

16. The deformed reinforcing bar as claimed in claim 11, wherein a plurality of second troughs arranged in a line and separated with intervals is disposed on the circumference of the long steel bar and at opposite side of the plurality of troughs of the accommodating recess; the second trough has the same structure as the troughs of the accommodating recess; the troughs of the accommodating recess and the plurality of second troughs are not aligned along the length.

17. A floor module structure, applicable to a pre-assembled construction process, comprising:

a plurality of horizontal fixed steel bars, a plurality of wrapping wires, a bottom template, and a plurality of truss structures perpendicularly disposed on the bottom template, arranged in parallel and separated with intervals along a vertical direction;

wherein each of the truss structures being a truss structure as claimed in claim 1;

a plurality of interval blocks being disposed between each truss structure and the bottom template along the vertical direction;

a long reinforcement element being disposed beneath the bottom template at location corresponding to each of the truss structures; the wrapping wires penetrating the bottom template to fasten a top chord of each of the truss structures and the corresponding long reinforcement element;

the horizontal fixed steel bars being disposed to set through under the top chord of the truss structure at two ends and the middle of the floor module structure, and welded or tied to fasten the horizontal fixed steel bars to the top chord to form the floor module structure.

* * * * *